United States Patent [19]

McHugh

[11] Patent Number: 4,469,387

[45] Date of Patent: Sep. 4, 1984

[54] PRINTED CIRCUIT BOARD CONNECTOR

[75] Inventor: Robert G. McHugh, Winston-Salem, N.C.

[73] Assignee: AMP Incorporated, Harrisburg, Pa.

[21] Appl. No.: 410,198

[22] Filed: Aug. 23, 1982

[51] Int. Cl.[3] ..... H01R 13/44

[52] U.S. Cl. ..... 339/42; 339/17 LC; 339/66 M; 339/196 M

[58] Field of Search ..... 339/65, 17 LC, 42, 210 M, 339/210 R, 66 R, 66 M, 196 R, 196 M, 206 R, 206 P

[56] References Cited

U.S. PATENT DOCUMENTS

| | | | |
|---|---|---|---|
| 2,444,843 | 7/1948 | Modrey | 173/328 |
| 3,167,373 | 1/1965 | Kostich | 339/42 |
| 3,601,762 | 8/1971 | Eshelman | 339/210 M |
| 3,651,444 | 3/1972 | Desso et al. | 339/42 |
| 3,754,205 | 8/1973 | Lenkey | 339/42 |
| 3,760,335 | 9/1973 | Roberts | 339/99 R |
| 3,793,720 | 2/1974 | Van Rijsewijk et al. | 29/626 |
| 3,874,762 | 4/1975 | Shott et al. | 339/196 R |
| 4,050,769 | 9/1977 | Ammon | 339/210 M |
| 4,108,526 | 8/1978 | McKee | 339/206 R |
| 4,274,698 | 6/1981 | Ahroni | 339/196 R |
| 4,340,267 | 7/1982 | Nukaga | 339/42 |
| 4,343,528 | 8/1982 | Lucius et al. | 339/206 R |

FOREIGN PATENT DOCUMENTS

| | | | |
|---|---|---|---|
| 660645 | 5/1938 | Fed. Rep. of Germany | 339/42 |

*Primary Examiner*—Joseph H. McGlynn
*Assistant Examiner*—Gary F. Paumen
*Attorney, Agent, or Firm*—Robert Usher; F. Brice Faller

[57] ABSTRACT

A printed circuit board connector having two parallel rows of posts for receipt in sockets of a printed circuit board includes an elongate post locating member formed on opposite faces with parallel post receiving channels mounted for sliding movement along the posts away from the free ends of the posts during insertion of the posts into the sockets of the printed circuit board. Inadvertent dislodgement of the locating member from the free ends of the posts is prevented by a stop member extending from the locating member engaging an abutment on the connector.

11 Claims, 4 Drawing Figures

33
32
29
28
24
31
25
22
13
11
26
12
14
15
16
15'
16'
33
31'
32'
25'
29'
28'
15
15'
16
16'
20
19
39
43
21
20
19'
18
23
42
41
37
38
39'
43'

PRINTED CIRCUIT BOARD CONNECTOR

The invention relates to electrical connectors particularly to printed circuit board connectors having a series of posts for insertion in sockets in printed circuit boards.

The posts are often of relatively fragile construction as they may be stamped from thin metal stock and project unprotected from the connector housing body. The posts are, therefore, susceptible to damage during transportation and handling. For this reason, locating blocks having channels receiving the respective posts are often provided to protect the free ends of the posts during transporting and handling, but it has been necessary to remove the blocks to free the posts for insertion into the respective sockets of the printed circuit board. It has nevertheless, been found that it is relatively difficult to align and insert the relatively long and flexible posts in the respective sockets as removal of the locating block may cause dislocation of the end posts which can hamper the application of the connector to the printed circuit board.

According to the invention, a printed circuit board connector comprises a body of insulating material from which project a series of flexible posts and a rigid post locating member receiving the posts in sliding engagement and retractable along the posts from a location adjacent the free ends of the posts by application of the connector to a printed circuit board to permit entry of the free ends of the posts into respective sockets of the printed circuit board.

Thus, the locating member maintains the correct pitch of the posts for initial entry in the sockets and is progressively pushed back by engagement with the printed circuit board during further insertion also ensuring that the posts do not flex throughout the entire insertion step.

Preferably, the posts are bent to extend transversely and rearwardly of contact portions of the connector. Use of the locating member will frequently not involve any increase in the height of the connector as clearance is usually available in such connectors for the locating member to be retracted from a location adjacent the free ends of the posts to a location adjacent the bend. The height of the structure is bent to a minimum which is particularly important in printed circuit board applications.

Preferably, a catch or stop member extends from the locating member transversely of the posts and is engageable with an abutment provided on the connector to prevent travel of the locating member substantially beyond the free ends of the posts.

Thus, inadvertent dislodgement of the guide member from the posts during handling is prevented.

Desirably, an over-rideable locating projection is provided on the locating member to prevent inadvertent withdrawal of the locating member from the free ends of the posts.

Preferably, the posts of the connector are arranged in two parallel rows and the guide member is located between the rows and is formed with channels on opposite sidewalls receiving respective posts.

The connector may include a bipartite shroud, the shroud parts being adapted to be releasably latched together and to the rear of the connector to enclose post portions adjacent the bend, the abutment comprising a bar formed on one part extending transversely of the posts.

A specific example of a printed circuit board connector according to the invention will now be described with reference to the accompanying drawings in which.

Figure 1:
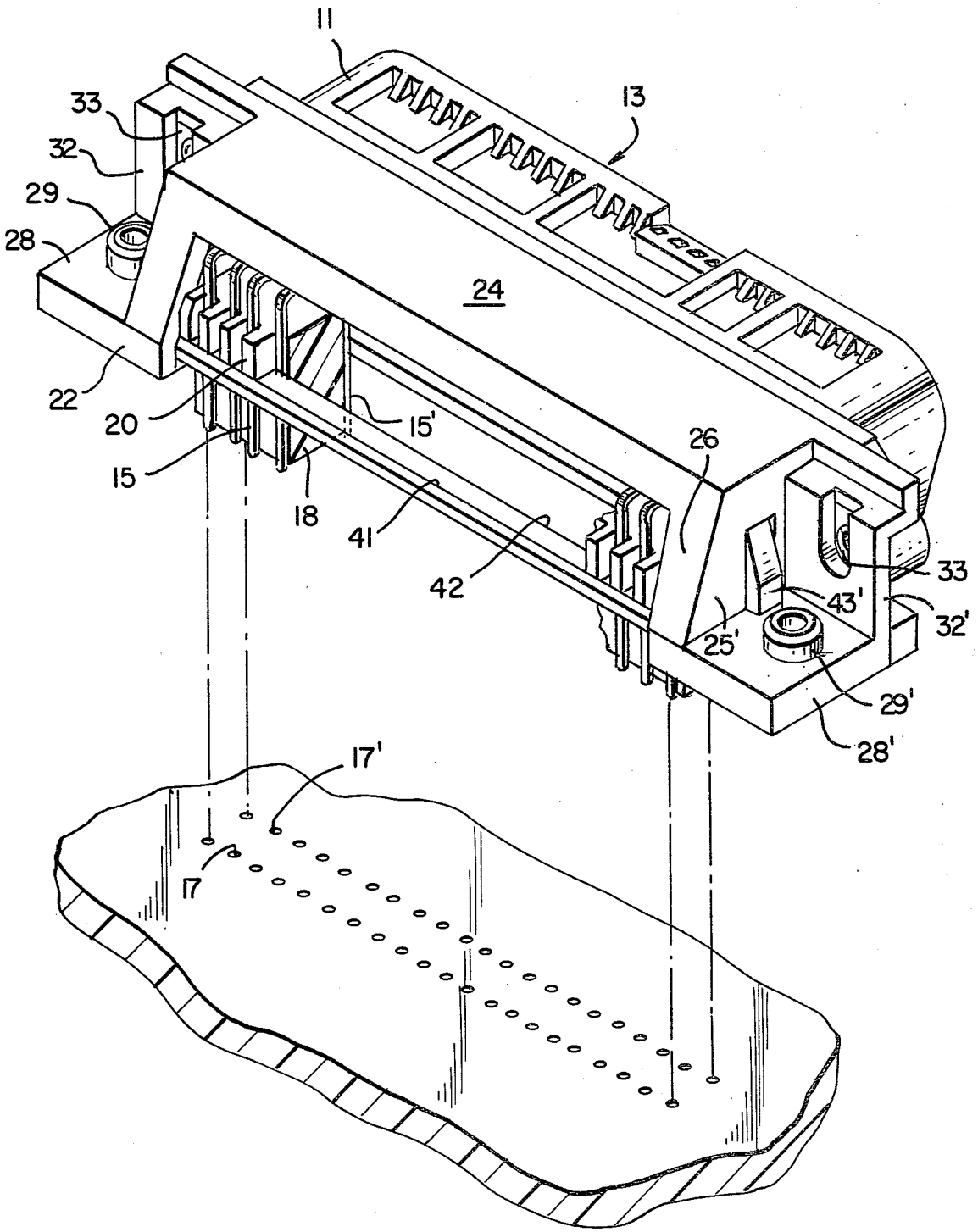
FIG. 1 is a perspective view of the connector.
Figure 2:
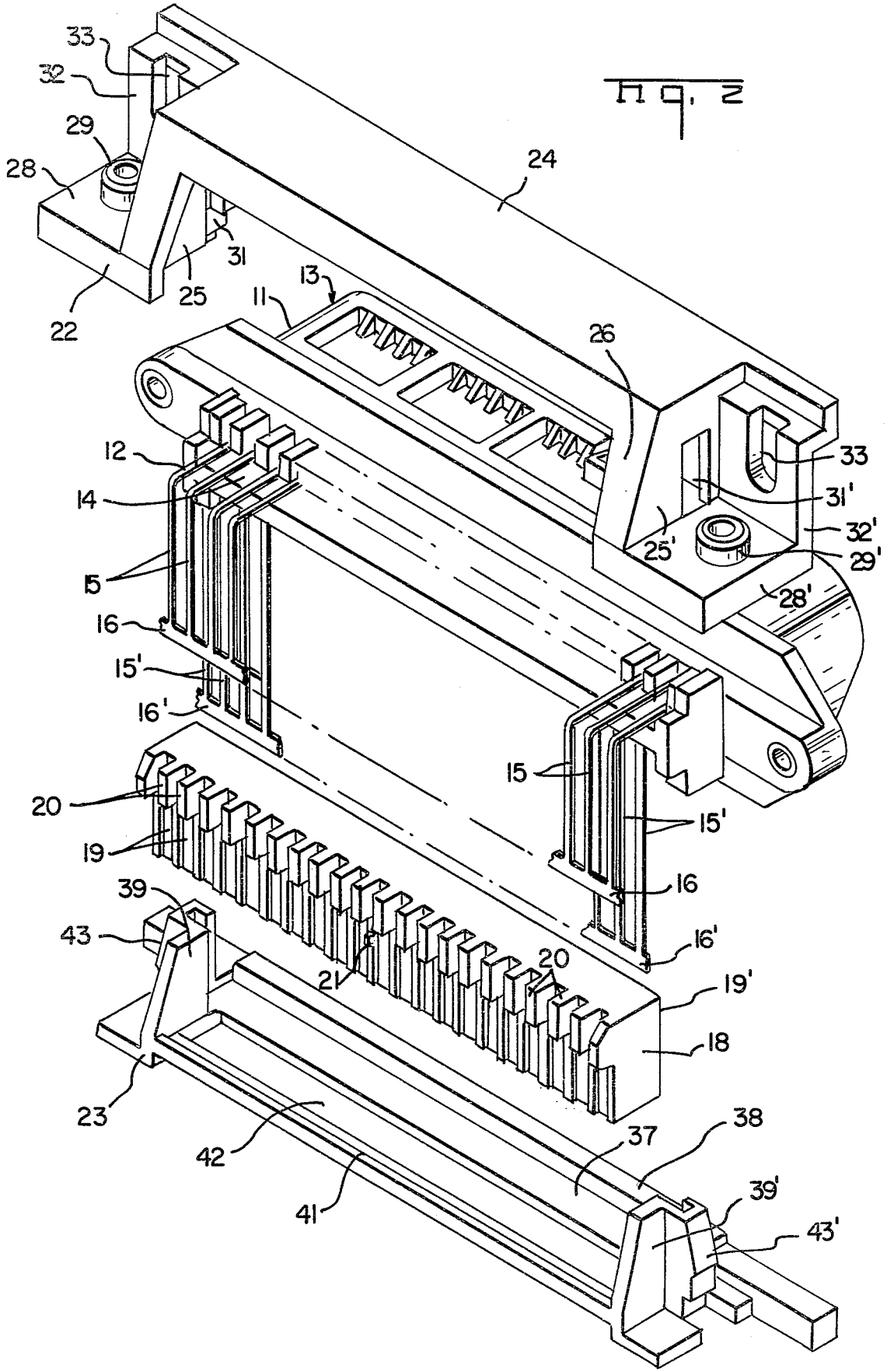
FIG. 2 is an exploded perspective view of the connector prior to assembly with the post locating member.
Figure 3:
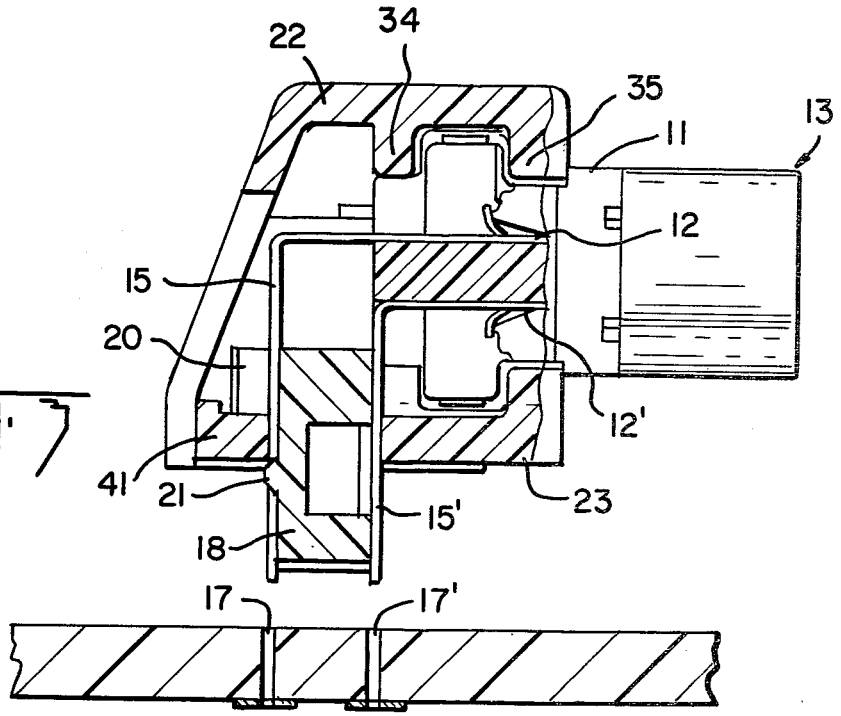
FIG. 3 is a cross-sectional view of the connector aligned for application to a printed circuit board; and, FIG. 4 is a cross-sectional view of the connector after mounting on a printed circuit board.
Figure 4:
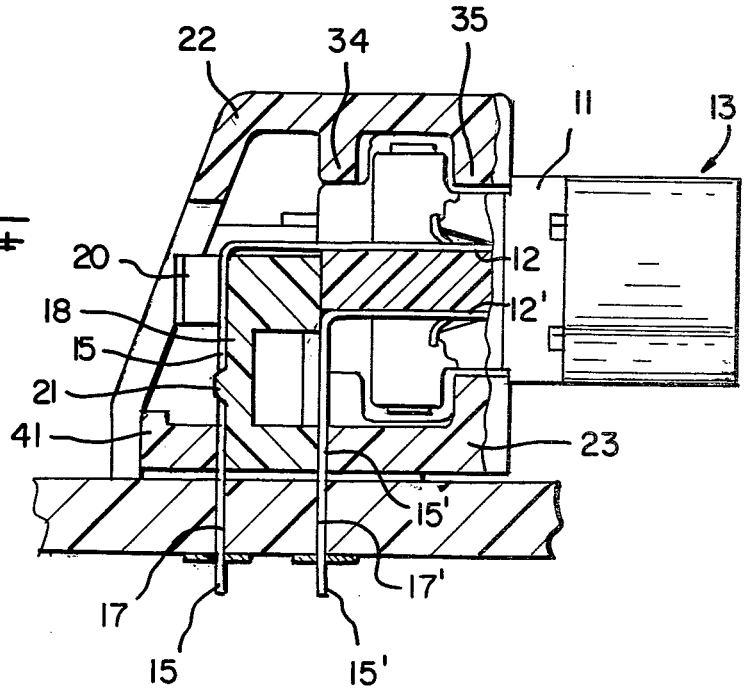

The connector comprises an insulating body 11 moulded of plastics material in which are mounted on two rows of stamped and formed, contacts 12, 12' extending between a front, mating, face 13 and a rear face of the body 11 on respective opposite sides of a rib 14. The contacts are bent through 90° at their exit from the rear of the body to provide transverse parts 15, 15' for reception in respective sockets 17, 17' or printed circuit board. Carrier strips 16, 16' locate the free ends of the posts at a predetermined pitch (corresponding to the pitch of the sockets of the printed circuit board) during assembly of the connector.

The body 11, contacts and posts are all of conventional design; the mating face, for example being as described in U.S. Pat. No. 3,760,335.

An elongate post locating member 18 is formed on opposite faces with parallel post receiving channels 19, and 19' located at the same pitch as the posts. Between each channel 19 at an upper end of the locating member extends a stop lug 20 and a locating projection 21 is formed between adjacent centrally located channels.

A bipartite shroud comprises upper and lower parts 22 and 23 respectively, each moulded in one piece of plastics material. The shroud part 22 is of inverted channel shape and comprises an upper wall 24 connected at opposite ends to respective sidewalls 25 and 25'. An open rear of the shroud part 22 is surrounded by a lip 26. The sidewalls are respectively joined to mounting flanges 28, 28' formed with apertures 29, 29' for mounting bolts. Latching apertures 31, 31' are formed in respective sidewalls 25, 25' and bolt-receiving slots 33, 33' are formed in front walls 34, 34' joining the sidewalls and mounting flanges.

The lower shroud part 23 comprises a base wall 37, a front edge of which is joined to an upstanding lip 38. Side walls 39, 39' upstand from opposite lateral ends of the base wall and an L-section abutment bar 41 extends between the sidewalls spaced from the base wall 37 to define between them a post-receiving aperture 42. Latches 43, 43' extend laterally outwardly from the respective sidewalls 39, 39'.

To assemble the connector, the locating member is inserted between the post rows 15 and 15' with the posts received as a sliding fit in respective channels 19. The shroud is then assembled over the rear end of the connector with the locating member and posts extending through the aperture 42 and the latches 43, 43' received in the apertures 31, 31' respectively in a snap fit. When assembled, the projection 21 will be located below abutment bar 41 and engageable with the abutment bar to prevent inadvertent movement of the locating member away from the free ends of the posts during handling and transportation.

The carrier strips 16 and 16' are severed from the free ends of the posts which remain located at the correct pitch solely by the locating member.

The locating member may be retracted to a small extent using finger pressure on the stop lugs 20 immediately prior to application to the printed circuit board to expose the free ends of the posts for alignment and registration with the sockets. Pressing the connector onto the printed circuit board causes the locating member to retract into the upper part of the shroud permitting complete insertion of the relatively fragile posts without risk of distortion and misalignment or consequential damage. Any tendency for the posts to bow away from the locating member will be reduced by engagement of the posts with the edges of the base wall 37 and the abutment bar 41. Even when fully retracted, the locating member is not elevated above the profile of the connection body and, consequently, no additional space is necessary to accommodate the locating member.

A significant reduction in damage and application time is obtained by using the connector incorporating the locating member, which reduction is particularly significant in the context of mass production techniques.

I claim:

1. A printed circuit board connector comprising a body of insulating material from which project a series of flexible posts and a rigid post locating member receiving the posts in sliding engagement and retractable along the posts from a location adjacent the free ends of the posts by application of the connector to a printed circuit board to permit entry of the free ends of the posts into respective sockets of the printed circuit board, the posts being arranged in two parallel rows, the post locating member being located between the rows and being formed with channels on opposite sidewalls which receive respective posts in a sliding fit.

2. A printed circuit board connector according to claim 1 wherein said body comprises a mating face and a rear face at substantially right angles, contacts extending between said faces being formed with bends between said faces, the posts being formed integrally with said contacts and extending from said rear face.

3. A printed circuit board connector according to claim 1 in which a catch or stop member extends from the locating member transversely of the posts and is engageable with an abutment provided on the connector to prevent travel of the locating member substantially beyond the free ends of the posts.

4. A printed circuit board connector according to claim 3 in which a locating projection is provided on the locating member to prevent inadvertent withdrawal of the locating member from the free ends of the posts.

5. A printed circuit board connector according to claim 2 in which a catch or stop member extends from the locating member transversely of the posts and is engageable with an abutment provided on the connector to prevent travel of the locating member substantially beyond the free ends of the posts and further including a bipartite shroud, the shroud parts being adapted to be releasably latched together and to the rear of the connector body to enclose post portions adjacent the bend, the abutment comprising a bar formed on one part extending transversely of the posts.

6. A printed circuit board connector comprising a body of insulating material from which project rearwardly a series of flexible posts having transversely bent rear portions with free ends protruding beyond an envelope defined by the transverse cross-sectional profile of the connector body characterized by a rigid post locating member receiving the rear portions in sliding engagement and retractable along the rear portions from a location adjacent their free ends to a location substantially within the envelope by application of the connector to a printed circuit board to provide guided entry of the free ends of the rear portions into respective sockets of the printed circuit board without an increase in connector height, the posts being arranged in two parallel rows, the post locating member being located between the rows and being formed with channels on opposite sidewalls which receive respective posts in a sliding fit.

7. A printed circuit board connector according to claim 6 in which a stop member extends from the locating member transversely of the rear portions and is engageable with an abutment provided on the connector to prevent travel of the locating member substantially beyond the free ends of the rear portions.

8. A printed circuit board connector according to claim 7 in which a locating projection is provided on the locating member to prevent inadvertent withdrawal of the locating member from the free ends of the rear portions.

9. A printed circuit board connector according to claim 6 in which the posts are arranged in two parallel rows and the guide member is located between the rows and is formed with channels on opposite sidewalls receiving respective rear portions in a sliding fit.

10. A printed circuit board connector according to claim 6 in which the connector includes a bipartite shroud, the shroud parts being adapted to be releasably latched together and to the rear of the connector body to enclose rear post portions adjacent the bend, the abutment comprising a bar formed on one part extending transversely of the rear post portions.

11. A printed circuit board connector according to claim 7 in which a the connector includes a bipartite shroud, the shroud parts being adapted to be releasably latched together and to the rear of the connector body to rear post portions adjacent the bend, the abutment comprising a bar formed on one part extending transversely of the rear post portions.

* * * * *